United States Patent [19]

Evans

[11] Patent Number: 4,698,884

[45] Date of Patent: Oct. 13, 1987

[54] ROLL FOR HOT FORMING STEEL ROD

[75] Inventor: Donald R. Evans, Pittsburgh, Pa.

[73] Assignee: Kennametal Inc., Latrobe, Pa.

[21] Appl. No.: 898,842

[22] Filed: Aug. 19, 1986

Related U.S. Application Data

[63] Continuation of Ser. No. 805,597, Dec. 10, 1985, abandoned, which is a continuation of Ser. No. 479,707, Mar. 28, 1983, abandoned.

[51] Int. Cl.[4] ..... B21B 45/00

[52] U.S. Cl. ..... 29/132; 29/124

[58] Field of Search ..... 29/110, 132, 124, 116

[56] References Cited

U.S. PATENT DOCUMENTS

| | | | |
|---|---|---|---|
| 2,313,227 | 3/1943 | DeBats | 80/58 |
| 3,609,849 | 10/1971 | Krol | 29/132 |
| 3,993,446 | 11/1976 | Okawa | 29/182.7 |
| 4,137,106 | 1/1979 | Doi et al. | 29/132 |

FOREIGN PATENT DOCUMENTS

| | | |
|---|---|---|
| 941869 | 4/1956 | Fed. Rep. of Germany . |
| 2703261 | 11/1978 | Fed. Rep. of Germany . |
| 506509 | 5/1973 | Japan . |
| 51-30513 | 3/1976 | Japan . |
| 504803 | 5/1939 | United Kingdom . |
| 1420693 | 1/1976 | United Kingdom . |
| 2036620 | 7/1980 | United Kingdom . |

OTHER PUBLICATIONS

Chemical Abstracts, vol. 84, No. 20, May 17, 1976, p. 224, Abstract No. 139598d.

Chemical Abstracts, vol. 85, No. 18, Nov. 1, 1976, p. 364, Abstract No. 129175v.

Chemical Abstracts, vol. 84, No. 12, Mar. 22, 1976, p. 289, Abstract No. 78360w.

*Primary Examiner*—Howard N. Goldberg
*Assistant Examiner*—Irene Graves Golabi
*Attorney, Agent, or Firm*—John J. Prizzi

[57] ABSTRACT

Disclosed herein is a carbide roll having an improved composition for hot forming steel rod in multi-stand rolling mills. The improved composition comprises the addition of nickel as a binder material to a normal tungsten carbide-cobalt roll composition, preferably, so that the composition by volume is approximately: tungsten carbide—70 percent; nickel—10 percent; and cobalt—20 percent. A dual composition is disclosed, wherein the above composition forms the inner layer of the roll and an outer layer may be composed of, by volume, tungsten carbide—70 percent and cobalt—30 percent.

3 Claims, No Drawings

ROLL FOR HOT FORMING STEEL ROD

This application is a continuation of application Ser. No. 805,597, filed Dec. 10, 1985, now abandoned, which is a continuation of Ser. No. 479,707, filed on Mar. 28, 1983, now abandoned.

BACKGROUND OF THE INVENTION

This invention concerns cemented carbide rolls for hot-forming steel rod in multi-stand rolling mills, especially in a finished rod diameter range of 7/32 inches to ½ inch. Carbide rolls, operating at rod temperatures typically in the 1700° F. to 2200° F. range, have gained wide use in multi-stand steel-rod rolling mills and, to a large extent, have replaced chilled cast iron rolls, especially in finishing roll mill stands.

The development of twist free rod mills allowed the use of higher, more economical hot rolling speeds without sacrifice of rod product dimensions or rod surface condition. The successful introduction of cemented carbide rolls of homogeneous, single-composition, tungsten carbide-cobalt alloys provided a roll material capable of being designed to withstand higher rolling speeds.

The sole hard carbide constituent in these roll alloys preferred by those skilled in the art, and most successful in application, has been tungsten carbide (WC) and cobalt.

The realization of the benefits of still greater rolling speeds of which improved mill design is now capable, however, requires roll materials possessing more toughness. Both the surface degradation of roll groove surfaces, or other working surface configuration, and massive roll fracture are related to several factors, among which major factors are thermal cracking caused by alternate heating and cooling of the mill roll as it encounters the hot steel rod and stresses due to mounting and torque transmission.

Rolls used for slower rolling speeds and larger rolling diameters, such as pre-finishing mills and bar mills having a finished rod diameter of one-half inch to three inches, are subject to even greater thermal stress because thermal cycling is accelerated by longer time intervals of roll-to-work contact and cooling exposure and, also, higher rolling torque and stresses due to the slower speed.

One of the causes of mill roll failure is due to the tensile stress imposed on the inside diameter of the mill roll when mounted in working position. The rolls are usually mounted on mandrels with means for exerting radially outward contact with the inside diameter of the roll. The contact with the mandrel must be sufficient so as to effect torque transmission between the mandrel and the roll. As cemented carbides are usually relatively weak in tensile strength, the tensile force imposed by the mandrel can cause failure of the roll. Bending stresses due to high torque transmission can also contribute to roll failures.

The addition of tantalum carbide (TaC) to the outer part of the roll helps control the thermal cracking of the outer layer due to thermal stresses but increases the cost of manufacture of the mill roll. In order to reduce the overall cost of the mill roll, it was thought that the substitution of nickel (Ni) for some of the cobalt in the inner ring could be achieved without any major loss in tensile strength or wear resistance, (Ni) being a less expensive commodity than cobalt (Co). Surprisingly, the addition of Ni to the binder material of the inner ring dramatically increases the tensile strength rather than reducing it.

It is an object of this invention to provide a cemented carbide roll for hot forming steel rod in multi-stand rod or bar mills which is significantly more resistant to thermal cracking and stress related failures.

It is an additional object of this invention to provide a roll which possesses greater toughness as evidenced by longer roll service time and greater steel tonnage rolled before failure of roll would occur.

BRIEF SUMMARY OF THE INVENTION

According to the present invention, a cemented carbide roll can have the thermal fatigue and toughness properties increased by the addition of nickel to the roll composition. Preferably, the composition of the roll near its inner surface will comprise, by volume: tungsten carbide—70 percent ; nickel—10 percent; and cobalt—20 percent; however, the composition may be in the range, by volume, of: tungsten carbide—45 to 72 percent; nickel—5 to 30 percent; and cobalt 0 to 42 percent.

Because of the cost of the cobalt, the use of nickel is also more economical in a dual compact roll with an outer layer preferably comprised of, by volume, 70 per cent tungsten carbide and 30 percent cobalt. The outer layer, however, may be in the range of, by volume, 24 to 43 percent cobalt, and the balance tungsten carbide and singly or in combination tantalum carbide, tantalum, nickel and chrome.

DETAILED DESCRIPTION OF THE INVENTION

The invention concerns a dual-composition carbide roll comprising a longer-wearing peripheral or outer cemented carbide zone in which the rolling grooves, or working surfaces, are formed and possessing exceptional thermal fatigue and wear resistance compositions, and a mechanically tough inner support core of tungsten carbide-cobalt-nickel or tungsten carbide-nickel alloy preferably possessing a binder volume and carbide grain structure identical with or similar to that which exists in the peripheral or outer zone.

Both zones form a solid, integrated roll body with a sinter-bonded interface. Carbide-cobalt-nickel powder blends suitable for each zone are first pressed together in a powder compacting press, then sintered together as a single pressing.

The improved mill roll possesses as its preferable feature a dual-composition cemented carbide structure, of which the outer or rolling zone will be a hard wear resistant material, preferably a tungsten carbide-cobalt cemented carbide composition and an inner zone of cemented tungsten carbide-cobalt nickel, preferably having identical or similar volume percent of binder metal.

It is recognized that dissimilarities between the zones in carbide grain size range, volume percent of binder and binder composition may cause an unacceptable rate of fracture failure of the roll because of inherent differences in thermal coefficient of expansion between the zones, either in use or during manufacture. Nevertheless, identical or similar percent binder volumes, carbide grain size ranges and binder compositions in the outer and inner zones are a preferred embodiment of this invention.

Cemented carbide rings were made having an outer zone composition in terms of percent by volume of tungsten carbide—70 percent; tantalum carbide—12 percent; and cobalt—30 percent, integrated by means of a sinter-bonded interface with an inner cemented carbide core zone having a composition in per cent by volume of tungsten carbide—70 percent and cobalt—20 percent, and nickel—10 percent.

Both zones were made to have a tungsten carbide grain size range of approximately 90 percent 3 to 12 micron. The design density of the outer and inner zone was approximately 13.55 grams per cubic centimeter. The outer zone was 0.250 inches thick, just sufficient in ratio to provide for outer zone material both to accommodate the forming of the rolling groove and the subsequent grinding of the groove between roll passes in an actual rod mill roll.

Carbide grain size ranges typically used in rolls in accord with the current art vary according to the precepts of manufacturers; it is recognized that at least some of the economic benefit of this invention will occur independently of grain size ranges employed in the peripheral and inner zones.

It should be understood that the volume per cent of binder, as well as the binder composition, may be altered in either or both zones without impairing some or any of the economic benefits of this invention, and that, further, the benefits of this invention can be realized in hot rolling metals other than steel.

Tests on the above concepts were carried out by making test rings as further described herein.

Test rings having approximate size of 3.500 inches OD×1.900 inches ID×0.500 inches thick were formed in a mechanical press. Initially, the outer ring of the designated composition and the inner ring of the designated composition were separated by a thin, metal sleeve. The sleeve was carefully removed and the powder was compacted in a single pressing and sintered as a single unit. Fifty per cent of the specimens were further subjected to hot isostatic pressing process.

Hot isostatic processing conditions for Items 2 and 4 were hot isostatically pressed at 2490 degrees Fahrenheit to 2500 degrees Fahrenheit for an eight hour time period and Item 6 was hot isostatically pressed at 2310 degrees Fahrenheit to 2370 degrees Fahrenheit for an eight hour time period.

With regard to Items 5 and 6, the low stress values were questionable and were attributed to the condition of the testing equipment, subsequently upgraded, and new tests (Item 7) were conducted.

The ring specimens were ground outside diameter, inside diameter and sides. The testing was accomplished by the use of a tapered sleeve and a tapered ram fitted into the inside diameter of the rings. Strain gauges were mounted on the outside diameter of each ring. The rings were placed into a hydraulic press and pressure was applied to the tapered ram and the tapered sleeve which expanded the ring specimens until failure occurred, and strain measurements recorded. Duplicate procedures were used to test rings consisting of only tungsten carbide and cobalt. The results of the test provided data indicating that the composite constructed rings possessed a tensile strength of approximately sixty percent higher than that of a single composition ring having the same percent binder and grain size.

TEST RESULTS

MECHANICAL TESTS ON THE COMPOSITE AND STRAIGHT CARBIDE RINGS

| Item | Rim | Core | Avg. of Max. Hoop Stress (PSI) | Std. Dev. (PSI) | Remarks |
|---|---|---|---|---|---|
| 1 | 20% Co | 20% Ni | 335,154 | 78,315 | (21) Rings Tested |
| 2 | 20% Co | 20% Ni | 337,649 | 100,787 | HIP (22) Rings Tested |
| 3 | 20% Co | 20% (2 Co: 1 Ni) | 379,652 | 68,468 | (24) Rings Tested |
| 4 | 20% Co | 20% (2 Co: 1 Ni) | 294,581 | 59,529 | HIP (22) Rings Tested |
| 5 | 20% Co | 20% Co | 156,597 | 57,211 | (20) Rings Tested |
| 6 | 20% Co | 20% Co | 150,719 | 48,814 | HIP (19) Rings Tested |
| 7 | 20% Co | 20% Co | 238,359 | 9,371 | Retest; (6) Rings Tested |

Modifications may be made within the scope of the appended claims.

What is claimed is:

1. A hot forming rod mill roll, comprising:

(a) an outer layer in the form of an outer ring composed of a first cemented carbide material having a first binder consisting of cobalt, said outer ring having a hard wear resistant peripheral working surface for engaging and hot forming rod products; and (b) an inner layer in the form of an inner ring composed of a second cemented carbide material having a second binder selected from the group consisting of nickel and cobalt-nickel alloys, said inner ring having an innermost mandrel engaging surface and said outer ring surrounding and bonded to said inner ring to form an integrated annular roll body, said second cemented carbide material with said second binder comprising: 45–72% tungsten carbide and the remainder cobalt and nickel in which the ratio of cobalt to nickel is 2:1.

2. The rod mill roll according to claim 1 in which said second cemented carbide material with said second binder comprises, by volume, approximately 70% tungsten carbide.

3. The rod mill roll according to claim 1 wherein said first cemented carbide material with said first binder is comprised of, by volume: tungsten carbide, 70 percent; cobalt, 30 percent; and said second cemented carbide material with said second binder comprises, by volume: tungsten carbide, 70 percent; cobalt, 20 percent; nickel, 10 percent.

* * * * *